US007721894B2

(12) United States Patent
Ishii

(10) Patent No.: US 7,721,894 B2
(45) Date of Patent: May 25, 2010

(54) SHOCK-ABSORBING PACKING MATERIAL, AND SHOCK-ABSORBING PACKING MATERIAL FOR TELEVISION RECEIVER

(75) Inventor: Hiroki Ishii, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 93 days.

(21) Appl. No.: 12/068,436

(22) Filed: Feb. 6, 2008

(65) Prior Publication Data

US 2008/0202979 A1 Aug. 28, 2008

(30) Foreign Application Priority Data

Feb. 8, 2007 (JP) ..... 2007-029513

(51) Int. Cl.
*B65D 81/02* (2006.01)

(52) U.S. Cl. ..... 206/586; 206/587; 206/523

(58) Field of Classification Search ..... 206/620, 206/326, 453, 523, 586, 587, 591, 592
See application file for complete search history.

(56) References Cited

U.S. PATENT DOCUMENTS 3,363,957 A * 1/1968 Basch ..... 206/523
4,883,179 A * 11/1989 Dionne ..... 206/453
6,405,866 B2 * 6/2002 Arima ..... 206/592
2002/0139706 A1 10/2002 Fujii
2002/0144923 A1 * 10/2002 Baechle ..... 206/453

FOREIGN PATENT DOCUMENTS

JP 58-65268-UM 5/1983
JP 61-77372-UM 5/1986
JP 3-176379 7/1991
JP 3072574 U 8/2000

* cited by examiner

*Primary Examiner*—Ehud Gartenberg
*Assistant Examiner*—Kaushikkumar Desai
(74) *Attorney, Agent, or Firm*—Morgan Lewis & Bockius LLP

(57) ABSTRACT

The shock-absorbing packing material has a pair of first grooves each formed in a portion of the interior face of the first wall in connection with the interior face of the second wall, and a pair of second grooves each formed in a portion of the interior face of the first wall in connection with the interior face of the third wall.

5 Claims, 8 Drawing Sheets

FIRST DROP TEST

SECOND DROP TEST

SHOCK-ABSORBING PACKING MATERIAL, AND SHOCK-ABSORBING PACKING MATERIAL FOR TELEVISION RECEIVER

CROSS-REFERENCE TO RELATED APPLICATIONS

This application is based on Japanese Patent Application No. 2007-029513 filed on Feb. 8, 2007, the contents of which are hereby incorporated by reference.

BACKGROUND OF THE INVENTION

1. Field of the Invention

The present invention relates to a shock-absorbing packing material which is put in a gap between an electronic device such as a television receiver and a cardboard box when the electronic device is packed in the cardboard box.

2. Description of Related Art

A television receiver, which is also hereinafter referred to as "TV receiver" for short, is packed in a cardboard box at the time of factory shipment. In packing a TV receiver in a cardboard box, a shock-absorbing packing material is put in a gap between the cardboard box and the TV receiver. The shock-absorbing packing material is a foamed resin molding, and specifically a member which absorbs a physical shock to prevent the shock from reaching the TV receiver when the cardboard box with the TV receiver packed therein receives the shock owing to e.g. drop of the cardboard box or collision with other object.

FIG. 10 is a front-side sectional view showing the condition where a TV receiver is packed in a cardboard box, which is known in the art. FIG. 11 is a lateral sectional view of the cardboard box with the TV receiver packed therein as shown in FIG. 10. FIG. 12 is a perspective view of a shock-absorbing packing material conventionally used for a TV receiver. As shown in FIGS. 10 and 11, a TV receiver 3 is packed in a cardboard box 1, and each shock-absorbing packing material formed from a foamed resin molding is arranged in contact with adjacent four faces of the cardboard box 1. Now, in the description below, a corner portion formed by butting different exterior faces on each other is termed "an exterior ridgeline", a corner portion formed by butting different interior faces on each other is termed "an interior ridgeline", a point where different exterior ridgelines gather is termed "an exterior apex", and a point where different interior ridgelines gather is termed "an interior apex".

Shock-absorbing packing materials 92*b* arranged against a lower portion of the TV receiver 3 is disposed so as to support the lower portion of the TV receiver 3 from left and right sides thereof. Shock-absorbing packing materials 92*a* and 92*c* arranged against an upper portion of the TV receiver 3 are disposed so as to support the upper portion of the TV receiver from front and rear sides thereof.

The shock-absorbing packing material 92*a* shown in FIG. 12 is arranged so as to support the exterior ridgeline of the front side of the upper portion of the TV receiver. However, the shock-absorbing packing materials 92*b* and 92*c* arranged in the other places have a similar shape. As shown in FIG. 12, the shock-absorbing packing material 92*a* has: a first wall 921 which is an elongated member; a second wall 922 having the same length as the first wall 921 has; and a pair of third walls 923 provided integrally with the first wall 921 and the second wall 922 at right angles with respect to the lengthwise directions of the first and second walls. The first wall 921 and second wall 922 are joined with their ends abutting against each other so that they coincide in lengthwise direction with each other.

When the TV receiver 3 is packed in the cardboard box 1, the shock-absorbing packing material 92*a* is disposed so that the interior ridgeline formed by the interior face of the first wall 921 and the interior face of the second wall 922 abuts against a corner ridge portion of the TV receiver 3 on the front side of the upper portion thereof. In addition, the paired third walls 923 are disposed with their interior faces abutting against two opposing side faces of the TV receiver 3. Likewise, the corner ridge portion located on the rear side of the upper portion of the TV receiver 3, and left and right corner ridge portions of the lower portion of the TV receiver are held by the shock-absorbing packing materials 92*b* and 92*c* (see FIGS. 10 and 11). Because of such arrangement that the TV receiver 3 is arranged in the cardboard box 1 with shock-absorbing packing materials 92*a*, 92*b* and 92*c* put therebetween, physical shocks owing to drop of the cardboard box 1 and collision with other object never reach the TV receiver.

Meanwhile, a TV receiver is often out of balance in weight on the whole depending on the shapes and layout of members and constituents arranged therein, which include a CRT (Cathode Ray Tube) and a power supply device, etc. In many TV receivers, they are heavier on the front side where an image-display portion of CRT is located compared to the other sides. When a cardboard box in which a TV receiver heavier on its front side as such is packed drops from an elevation, a corner ridge portion or an apex portion of the front side of the cardboard box will come into contact with the face of the floor first.

Hence, drop tests in which actual dropping conditions of a cardboard box with a TV receiver 3 packed therein are duplicated have been carried out. FIG. 13 is an illustration for explanation of such drop tests. The indications of front and bottom faces in FIG. 13 represent the faces which the front and bottom faces of the TV receiver 3 front on.

As described above, the TV receiver 3 is out of balance in weight on the whole. Therefore, in the first test, the cardboard box is dropped so that an apex formed by its front, upper and side faces comes into contact with the face of the floor first, as shown in FIG. 13. After that, in the second test, the cardboard box is dropped so that a ridgeline formed by the front face and upper face comes into contact with the face of the floor first. In this test, the exterior face of the first wall 921 of the shock-absorbing packing material 92*a* abuts against the upper face of the cardboard box 1, the exterior face of the second wall 922 abuts against the front face, and the exterior faces of the paired third walls 923 abut against the two side faces.

FIG. 14 is a sectional view showing the result of the drop test. After the first test, in the shock-absorbing packing material 92*a*, a crack Cr arose extending from the following three ridgelines: i.e. the interior ridgeline formed by interior faces of the first wall 921 and the second wall 922; the interior ridgeline formed by interior faces of the second wall 922 and the third wall 923; and the interior ridgeline formed by interior faces of the third wall 923 and the first wall 921 located near the apex that reached the floor face first.

As shown in FIG. 14, formed was a crack Cr running from the interior ridgeline formed by the first wall 921 and the second wall 922 of the shock-absorbing packing material 92*a* to the exterior ridgeline formed by the first wall 921 and the second wall 922, i.e. a crack Cr running at an angle of 45 degrees with respect to the faces of the first wall 921 and the second wall 922 against which the TV receiver 3 abutted. The shock-absorbing packing material 92*a* with the crack Cr thus formed was used to execute the second test. Then, the cardboard box received a shock owing to the weight of the TV receiver 3 which widened the crack Cr of the shock-absorbing packing material 92*a*, namely a shock enough to jam the corner ridge portion of the TV receiver 3 into the crack Cr. Consequently, the crack Cr of the shock-absorbing packing material 92*a* reached the exterior ridgeline, and the TV receiver 3 ended up as crashing into the face of the floor and being fractured.

To avoid the transmission of a physical shock to the TV receiver 3 in the two tests, it is sufficient to make larger the thickness of the shock-absorbing packing material, thereby to enhance the shock-absorbing ability of the shock-absorbing packing material 92*a*. However, the increase in the thickness of the shock-absorbing packing material 92*a* boosts the amount of the foamed resin used to form the shock-absorbing packing material 92*a* and therefore raises the cost. In addition, the increase in the thickness of the shock-absorbing packing material 92*a* makes larger outer dimensions of the cardboard box 1. Such increase of the outer dimensions decreases the number of cardboard boxes which can be loaded in a container used for shipment of TV receivers 3, resulting in the increase in the transportation cost.

Under these circumstances, a method for reducing the fracture of the shock-absorbing packing material owing to the shock by drop has been proposed. For instance, JP-UM-A-58-65268 discloses a device in which relief portions having the shape of a groove are provided in two faces forming a ridgeline in order to disperse a stress produced in a corner portion at the time of drop, and in the other face, i.e. the remaining one of three faces forming the ridge corner of interest, a relief portion is provided diagonally with respect to the ridge corner. According to the device, the stress arising at the time of drop can be dispersed.

Also, JP-UM-A-61-77372 discloses a device in which a reentrant portion is provided in a corner portion to control the force caused by a physical shock, whereby a fracture is minimized.

Further, in the device disclosed by Japanese Utility Model Registration No. 3,072,574, a gap is formed between a corner portion of a shock-absorbing material and a corner portion of a TV receiver, thereby preventing direct transmission of the force caused by a physical shock to the TV receiver.

However, the device disclosed by JP-UM-A-58-65268 is based only on the assumption that a corner ridge portion comes into contact with a floor first, i.e. only the condition where the second test as shown in FIG. 13 is executed is assumed therein. In reality, it is conceivable that the force is applied all the three corner ridge portions as assumed in the first test. In such case, the stress can be concentrated on a corner ridge portion where no relief portion is formed.

Also, while in the device disclosed by JP-UM-A-61-77372, a reentrant portion is provided in a corner portion to control the force caused by a physical shock, the reentrant portion for controlling such force has a complicated form, and needs labor and time for manufacturing. In addition, with the device, a corner portion of a cardboard box is squashed thereby to reduce the first shock for the purpose of dispersing the force caused by a physical shock. Therefore, when drop of the cardboard box (the second test) is executed so that the corner ridge portion reaches a floor first after the first drop of the corner portion (the first test), the effect of the reentrant portion cannot be expected.

Moreover, with the device disclosed by Japanese Utility Model Registration No. 3,072,574, the transmission of the force caused by a physical shock from the shock-absorbing material to the TV receiver is delayed thereby to consume the energy when the shock-absorbing material is deformed, and thus the force caused by a physical shock is weakened. However, when the shock-absorbing material receives a physical shock such that the shock-absorbing material is fractured, the shock will be transmitted to the TV receiver.

SUMMARY OF THE INVENTION

Therefore, it is an object of the invention to provide a shock-absorbing packing material which can avoid direct contact of a TV receiver with a floor even when a cardboard box with the TV receiver packed therein is dropped so that a corner portion or corner ridge portion reaches the floor first.

A shock-absorbing packing material according to an embodiment of the invention is intended to abut against a corner ridge portion of an electronic device and lessen a physical shock to the electronic device when the electronic device is packed in a cardboard box, and includes: an elongated main body portion having an L-like shape in section and including a first wall and a second wall orthogonal to the first wall; and a pair of third walls joined to the first wall and the second wall at two opposite ends of a lengthwise direction of the main body portion orthogonally to the first wall and the second wall, and integrated with the main body portion. The first wall has: a pair of first grooves each having a well-like shape in section formed in a portion of an interior wall face of the first wall in connection with an interior wall face of the second wall, the pair of first grooves extending along the lengthwise direction; and a pair of second grooves each having a well-like shape in section formed in a portion of the interior wall face of the first wall in connection with an interior wall face of the corresponding one of the pair of third walls, in which each second groove is joined to the corresponding first groove and extends orthogonally to the first groove. The second wall has a pair of third grooves formed in its exterior wall face; the paired third grooves each extend in a direction orthogonal to an exterior wall face of the first wall.

According to the above configuration, under the condition where a crack formed in a corner ridge portion of the shock-absorbing packing material after the first test, in which the test package is dropped with a corner portion thereof kept down, extends from the corner ridge portion toward one of the faces forming the corner ridge portion, even when the second test is carried out, in which the test package is dropped with the corner ridge portion including the corner portion of interest kept down, the TV receiver never crashes into the floor because of the buffering effect of the shock-absorbing packing material.

In the shock-absorbing packing material according to the preferred embodiment of the invention, each of the pair of third grooves has: a first interior face perpendicular to the exterior wall face of the second wall; and a second interior face in parallel to the first interior face, but closer to a center of the main body portion in a longitudinal direction thereof and shallower than the first interior face. In addition, the first interior face is arranged so as to flush with the interior wall face of the third wall.

A shock-absorbing packing material for a TV receiver according to another embodiment of the invention is intended for lessening a physical shock to a TV receiver with a CRT (Cathode Ray Tube), which abuts against a corner ridge portion of the TV receiver and lessens the shock when the TV receiver is packed in a cardboard box. The shock-absorbing packing material is composed of a foamed resin molding, and includes: an elongated main body portion having an L-like shape in section and including a first wall and a second wall orthogonal to the first wall; and a pair of third walls joined to the first wall and the second wall at two opposite ends of a lengthwise direction of the main body portion orthogonally to the first wall and the second wall, and integrated with the main body portion. The first wall has: a pair of first grooves each having a well-like shape in section formed in a portion of an interior wall face of the first wall in connection with an interior wall face of the second wall, the pair of first grooves extending along the lengthwise direction; and a pair of second grooves each having a well-like shape in section formed in a portion of the interior wall face of the first wall in connection with an interior wall face of the corresponding one of the pair of third walls, in which each second groove is joined to the corresponding first groove and extends orthogonally to the first groove. The second wall has a pair of third grooves formed in its exterior wall face. The paired third grooves extend from a plane at a distance of 25 millimeters from and in parallel with the interior wall face of the first wall in a direction orthogonal to the lengthwise direction of the main body portion and opposite to the first wall. Further, each of the pair of third grooves has: a first interior face perpendicular to the exterior wall face of the second wall; a second interior face in parallel to the first interior face, but closer to a center of the main body portion in a longitudinal direction thereof and shallower than the first interior face; and a third bottom face joining between the first and second interior faces. Furthermore, the first interior face is arranged so as to flush with the interior wall face of the third wall.

DESCRIPTION OF THE PREFERRED EMBODIMENTS

Figure 1:
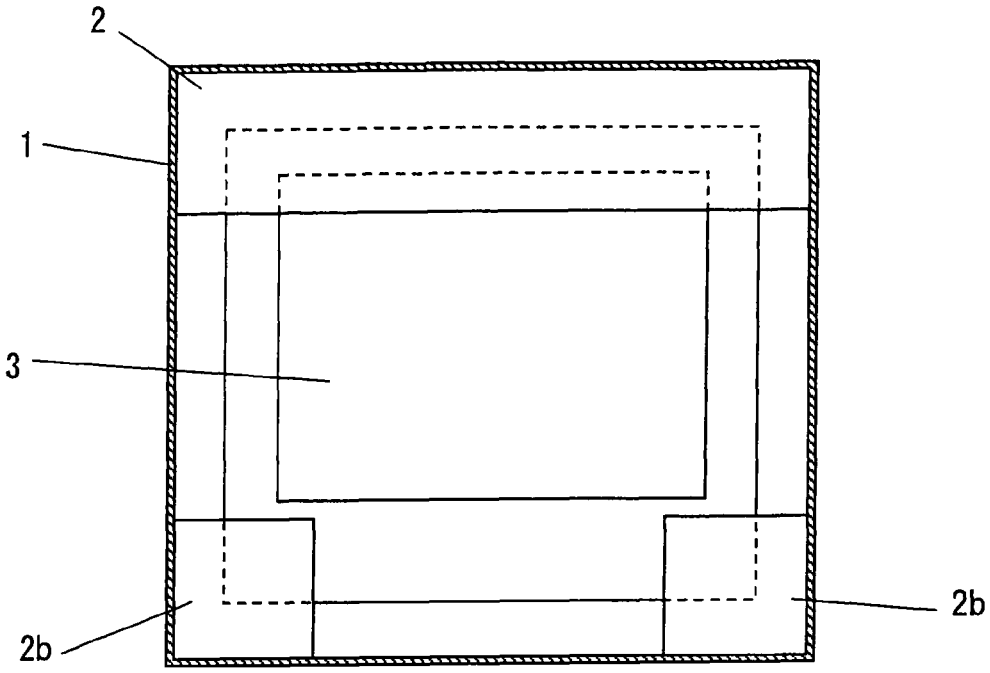
FIG. 1 is a front-side sectional view showing a condition where a set of shock-absorbing packing materials according to an embodiment of the invention is used to pack a TV receiver in a cardboard box.
Figure 2:
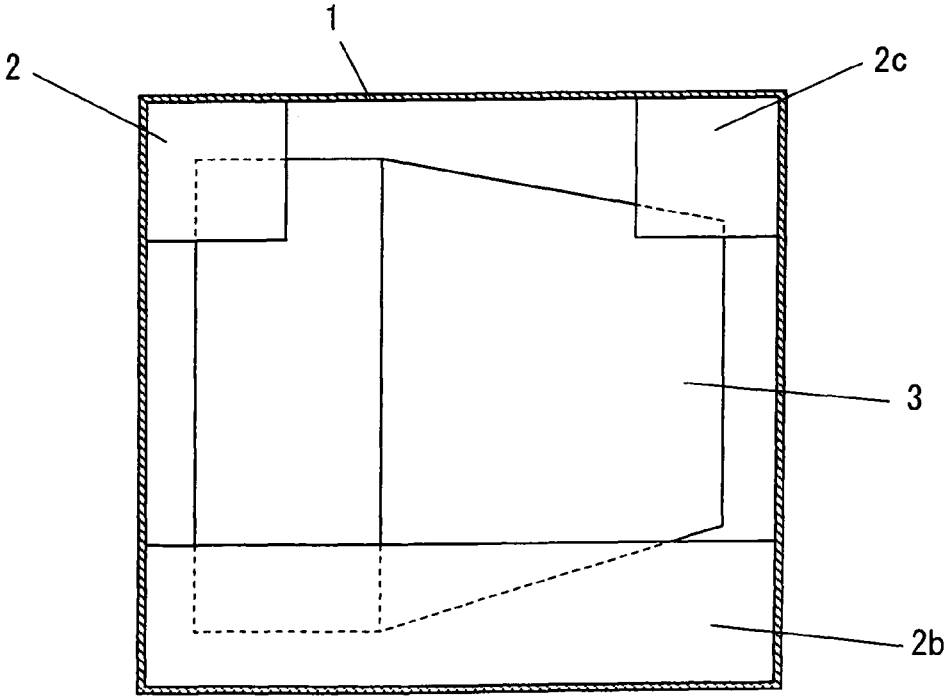
FIG. 2 is a lateral sectional view of the condition where the TV receiver is packed shown by FIG. 1.

An embodiment of the invention will be described below with reference to the drawings. FIG. 1 is a front view showing a condition where a set of shock-absorbing packing materials according to an embodiment of the invention is used to pack a TV receiver in a cardboard box. FIG. 2 is a side view of the condition where the TV receiver is packed shown by FIG. 1. As shown in FIGS. 1 and 2, shock-absorbing packing materials 2*b* are disposed on the bottom face of the cardboard box 1 prepared in a rectangular parallelepiped shape, on which the TV receiver 3 is placed with its two opposite side portions of the lower face side supported by the shock-absorbing packing materials 2*b* for the bottom face. Further, shock-absorbing packing materials 2 and 2*c* are disposed on the front and rear sides of the upper face of the TV receiver 3, whereby the TV receiver 3 is disposed in the cardboard box 1 so that it is not brought out of position.

Figure 3:
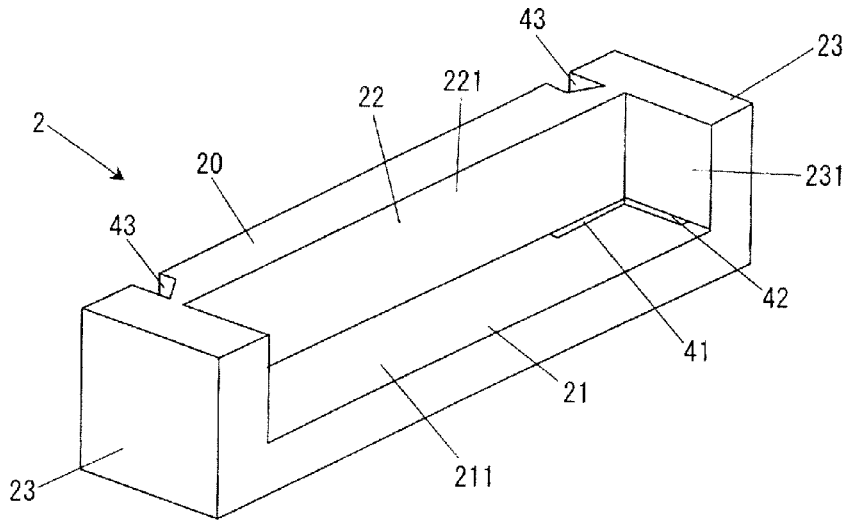
FIG. 3 is a perspective view of the shock-absorbing packing material according to the embodiment of the invention.
Figure 4:
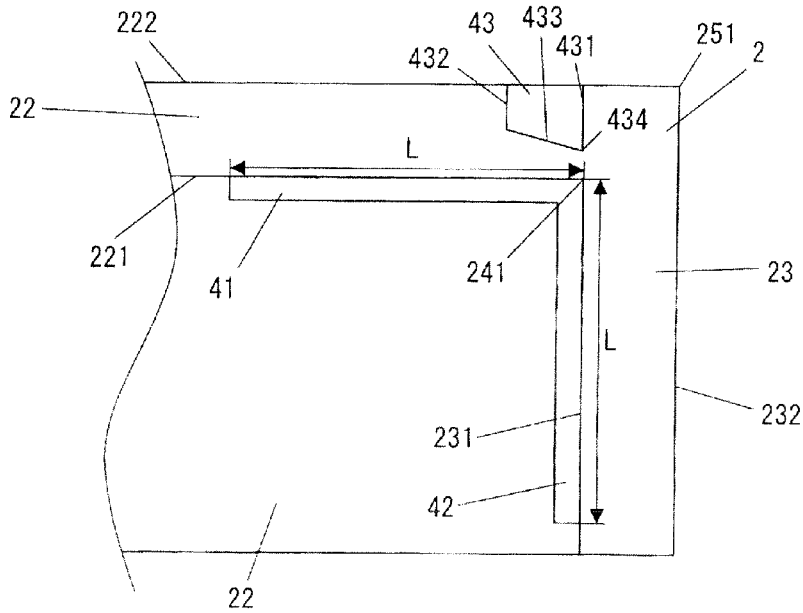
FIG. 4 is a plan view of the shock-absorbing packing material shown in FIG. 3.
Figure 5:
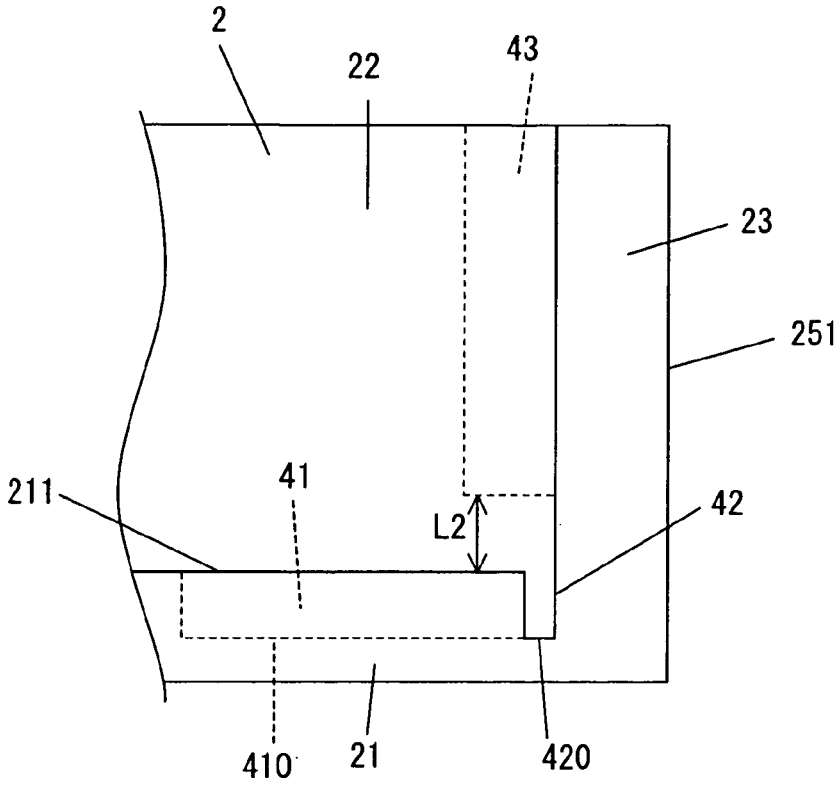
FIG. 5 is a front view of the shock-absorbing packing material shown in FIG. 3.
Figure 6:
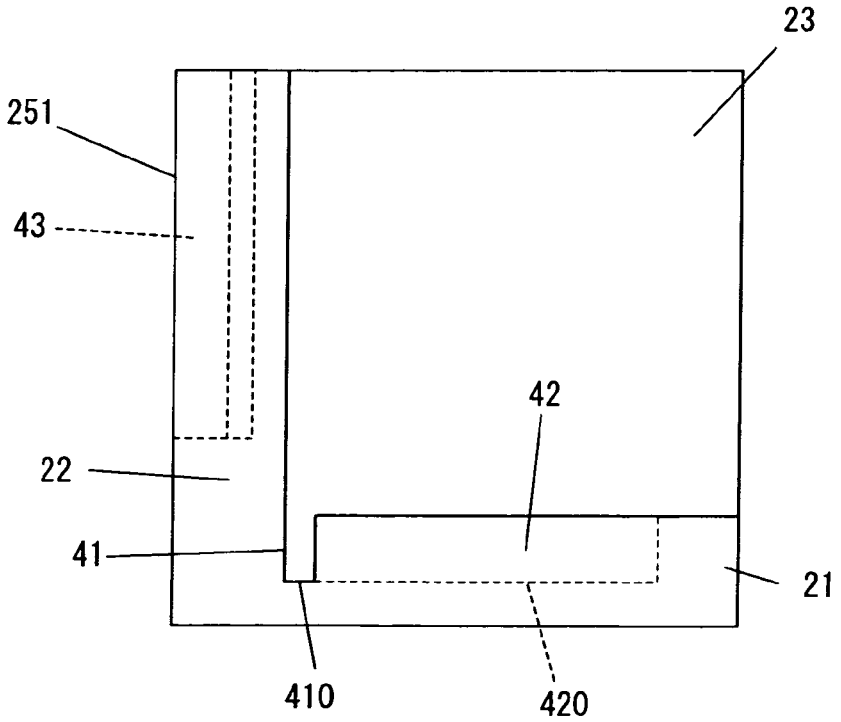
FIG. 6 is a side view of the shock-absorbing packing material shown in FIG. 3.

FIG. 3 is a perspective view of the shock-absorbing packing material according to an embodiment of the invention. FIG. 4 is a plan view of the shock-absorbing packing material shown in FIG. 3. FIG. 5 is a front view of the shock-absorbing packing material shown in FIG. 3. FIG. 6 is a side view of the shock-absorbing packing material shown in FIG. 3. Now, it is noted that in the description below, a corner portion formed by butting different exterior faces on each other is termed "an exterior ridgeline", a corner portion formed by butting different interior faces on each other is termed "an interior ridgeline", a point where different exterior ridgelines gather is termed "an exterior apex", and a point where different interior ridgelines gather is termed "an interior apex". In addition, in the description below, the shock-absorbing packing material 2 which holds the ridgeline formed by the front and upper faces of the TV receiver 3 will be described mainly. The shock-absorbing packing material 2 is a member having a symmetric shape. While only a groove on one side thereof is shown in the drawing for the sake of convenience, the shock-absorbing packing material 2 is shaped so as to be geometrically symmetric in reality.

As shown in FIGS. 3 to 6, the shock-absorbing packing material 2 has: an elongated main body portion 20 having an L-like shape in section including a first wall 21 and a second wall 22 orthogonal to the first wall 21; and a pair of third walls 23 joined to the first wall 21 and the second wall 22 at two opposite ends of a lengthwise direction of the body portion of the main body portion 20 orthogonally to the first wall 21 and the second wall 22 and integrated with the main body portion.

Also, the shock-absorbing packing material 2 has: a first groove 41 formed in a portion of an interior face 211 of the first wall 21, which adjoins an interior face 221 of the second wall 22; and a second groove 42 formed in a portion of the interior face 211 of the first wall 21, which adjoins an interior face 231 of one of the pair of third walls 23. Further, as shown in FIG. 4, the first groove 41 and the second groove 42 are formed so that they make one contiguous shape, in which the first groove 41 extends from the interior face 231 of the third wall 23 to a length of L, and the second groove 42 extends from the interior face of the second wall 22 to a length of L.

In the exterior face 222 of the second wall 22, a third groove 43 is formed. The third groove 43 has: a first interior wall face 431 which is flush with the interior face 231 of the third wall 23; a second interior wall face 432 which is opposed to the first interior wall face 431 and extends from the exterior face 222 of the second wall 22 to a depth shallower than the depth that the first interior wall face 431 extends to; and a bottom face 433 connecting and lying between ends of the first interior wall face 431 and the second interior wall face 432, which are the farthest, in depth, from the exterior face 222. An interior ridgeline 434 formed by the bottom face 433 and the first interior wall face 431 is in parallel with an interior ridgeline 241 formed by the interior face 221 of the second wall 22 and the interior face 231 of the third wall 23, and is located nearer to the interior ridgeline 241 in comparison to other portions of the third groove 43. Moreover, as shown in FIGS. 5 and 6, the third groove 43 is formed so as to extend from a place at a distance of L2 from the interior face of the first wall 21 in parallel with an exterior ridgeline 251 formed by the second wall 22 and the third wall 23.

Figure 13:
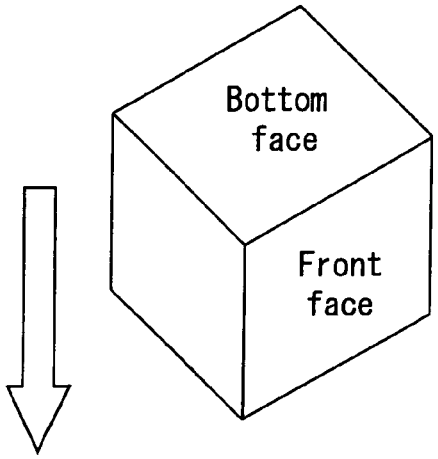
FIG. 13 is an illustration for explanation of drop tests including the first drop test.
Figure 13:
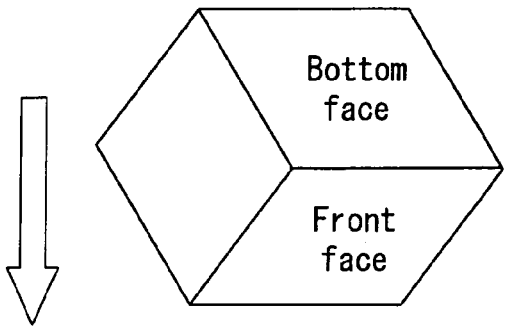
Figure 14:
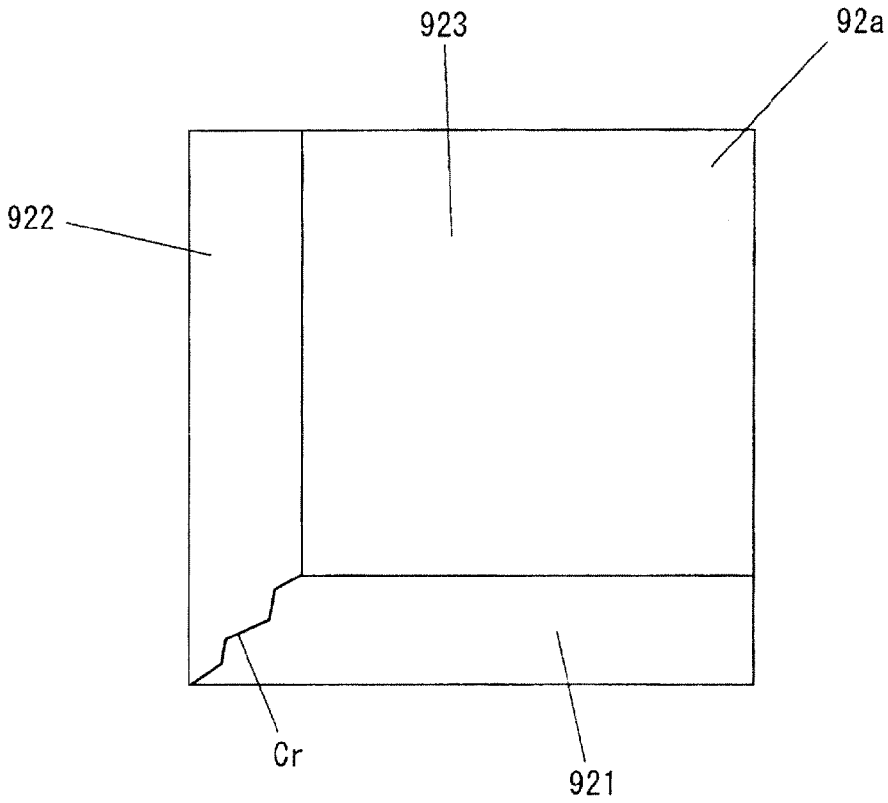
Fig.14 Prior Art
FIG. 14 is a sectional view showing the result of the drop test.

The shock-absorbing packing material 2 with the first groove 41, the second groove 42 and the third groove 43 formed therein is used to pack the TV receiver 3 in the cardboard box 1, and then one of the drop tests as shown in FIG. 13, namely the first drop test was carried out. In the first drop test, the cardboard box 1 was dropped so that the apex formed by the upper, front and side faces thereof came into contact with the face of the floor first. Then, the shock-absorbing packing material 2 packed in the cardboard box 1 received a shock in a direction from an exterior apex formed by the first wall 21 and the second wall 22 and one of the pair of third walls 23 toward the interior apex.

Figure 7:
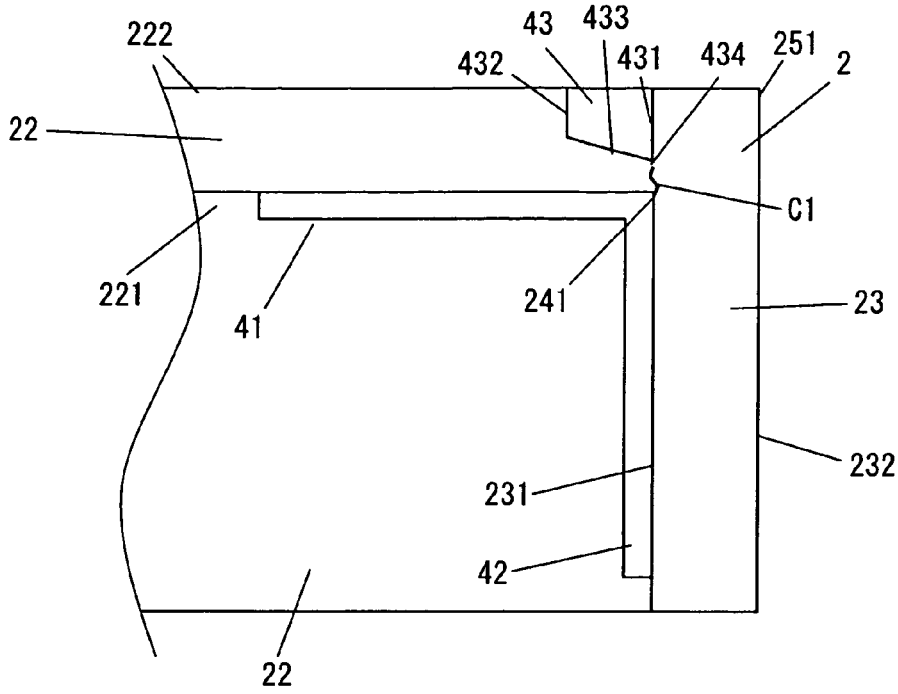
FIG. 7 is a plan view of the shock-absorbing packing material after execution of the first drop test as described with reference to FIG. 13.
Figure 8:
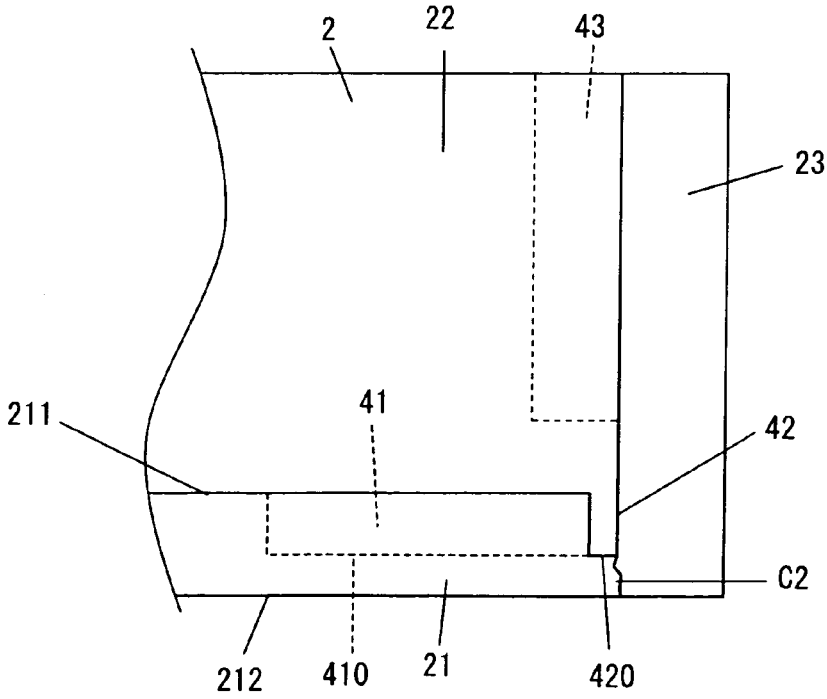
FIG. 8 is a front view of the shock-absorbing packing material after execution of the first drop test as described with reference to FIG. 13.
Figure 9:
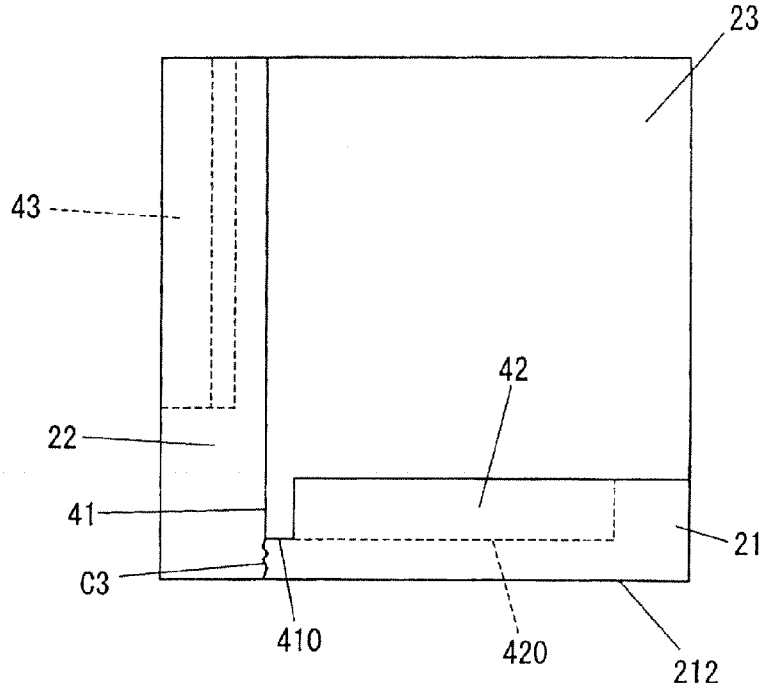
FIG. 9 is a side view of the shock-absorbing packing material after execution of the first drop test as described with reference to FIG. 13.
Figure 10:
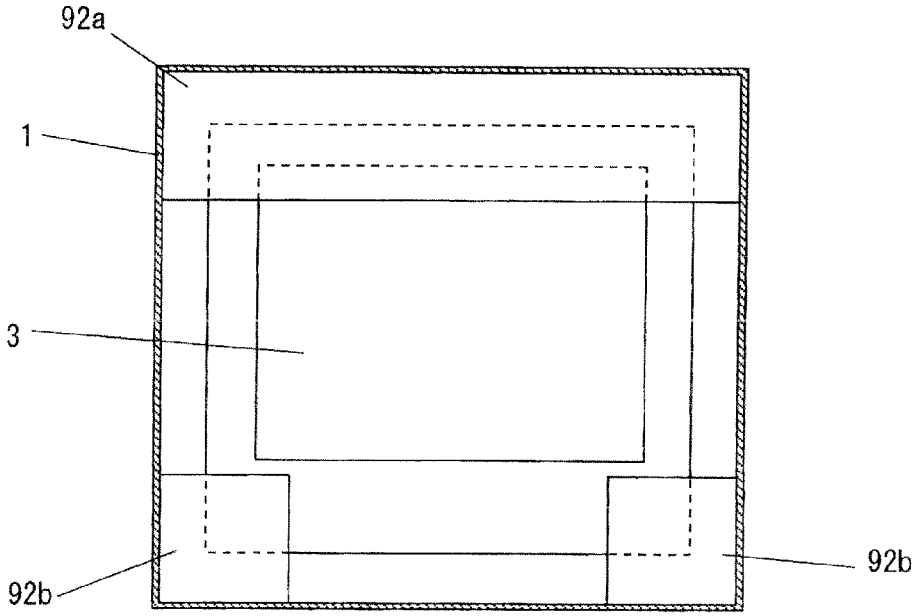
Fig.10 Prior Art
FIG. 10 is a front-side sectional view showing the condition where a TV receiver is packed in a cardboard box according to a conventional art.
Figure 11:
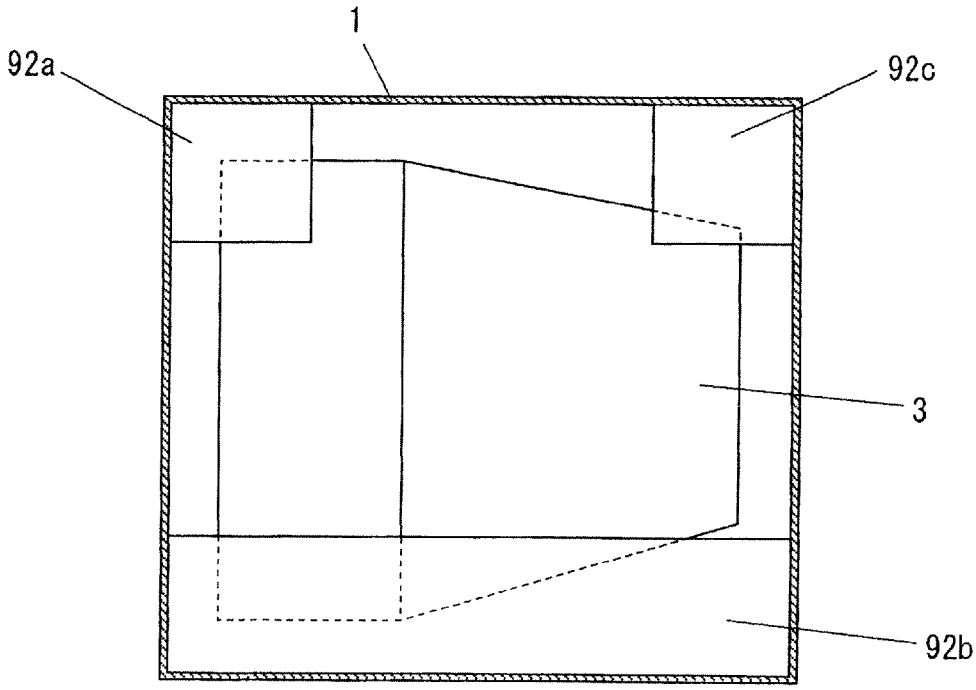
Fig.11 Prior Art
FIG. 11 is a lateral sectional view of the condition of the cardboard box with the TV receiver packed therein shown by FIG. 10.
Figure 12:
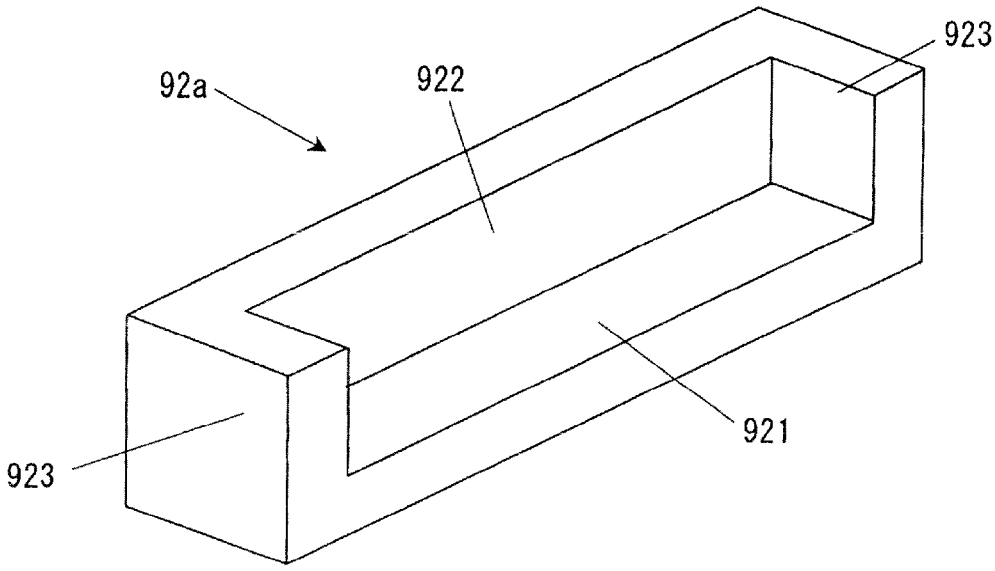
Fig.12 Prior Art
FIG. 12 is a perspective view of a conventional shock-absorbing packing material used to pack a TV receiver.

FIG. 7 is a plan view of the shock-absorbing packing material after execution of the first drop test as described with reference to FIG. 13. FIG. 8 is a front view of the shock-absorbing packing material after execution of the first drop test as described with reference to FIG. 13. FIG. 9 is a partial side view of the shock-absorbing packing material after execution of the first drop test as described with reference to FIG. 13.

As shown in FIG. 7, after the first drop test, a crack C1 was formed, which was likely to join between the interior ridgeline 434 of the third groove 43 and the interior ridgeline 241 formed by the interior face 221 of the second wall 22 and the interior face 231 of the third wall 23. The crack had a form extending within the limits of the second wall 22. This implies that at the time of drop, the stresses concentrated on the interior ridgeline 434 of the third groove 43 and the interior ridgeline 241 formed by the second wall 22 and third wall 23.

Further, as shown in FIGS. 8 and 9, a crack C2 was formed extending from an end portion face 420 of the bottom of the second groove 42 toward the exterior face 212 of the first wall 21, and a crack C3 was made running from an end portion face 410 of the bottom of the first groove 41 toward the exterior face 212. It is conceivable that the cracks C2 and C3 were formed by the stresses concentrating on the first groove 41 and the second groove 42. Also, it can be conceived that as the crack C1 formed on the third groove 43 released the energy for the crack C3 opened in the bottom end portion face 410 of the first groove 41 to extend inclining toward the side of the second wall 22, the crack C3 extended in the first wall 21 without inclining toward the side of the second wall 22. Likewise, it can be conceived that the crack C2 opened in the bottom end portion face 420 of the second groove 42 extended in the first wall 21 without inclining toward the side of the third wall 23.

Still further, it can be conceived in this case that the third groove 43 was spaced, by the distance of L2, apart from the plane including the interior face 211 of the first wall 21 as shown in FIGS. 5 and 6, which produced the following effect. That is, the shock-absorbing packing material 2 could be prevented from being smashed into fragments near and in the corner portion, which had come into contact with the face of the floor first in the first drop test, owing to the stress (energy) excessively concentrated on the corner portion.

In the second drop test, the shock-absorbing packing material 2 with the cracks C1, C2 and C3 formed therein as shown in FIGS. 7 to 9 was used as it was. As shown in FIG. 13, the cardboard box 1 was dropped with the corner ridge portion formed by the front and upper faces down. When dropped, the shock-absorbing packing material 2 received a shock in the direction from the exterior ridgeline toward the interior ridgeline formed by the first wall 21 and the second wall 22.

The crack C3 running from the bottom end portion face 410 of the first groove 41 reached the exterior face 212 of the first wall 21 as shown in FIG. 9. However, no crack was formed in the direction in which the shock is applied. As the portion of the shock-absorbing packing material 2 joining between the first wall 21 and the second wall 22 absorbs the shock as applied in the second test, it is possible to avoid that the corner ridge portion of the TV receiver 3 is directly smashed against the floor and thus the TV receiver 3 is fractured.

While the embodiment of the invention has been described above specifically, the invention is not limited to the embodiment. Various changes and modifications may be made without departing from the subject matter hereof.

The invention is applicable to a shock-absorbing packing material which can lessen a physical shock in the situation where it is packed in a cardboard box together with a TV receiver in transporting the TV receiver.

What is claimed is:

1. A shock-absorbing packing material for lessening a physical shock, which abuts against a corner ridge portion of an electronic device to lessen the shock to the electronic device when the electronic device is packed, comprising:

an elongated main body portion having an L-like shape in section and including a first wall and a second wall orthogonal to the first wall; and a pair of third walls joined to the first wall and the second wall at two opposite ends of a lengthwise direction of the main body portion orthogonally to the first wall and the second wall, and integrated with the main body portion, the shock-absorbing packing material characterized in that the first wall has a pair of first grooves formed in a portion of an interior wall face of the first wall in connection with an interior wall face of the second wall, the pair of first grooves extending along the lengthwise direction, and a pair of second grooves formed in a portion of the interior wall face of the first wall in connection with an interior wall face of the corresponding one of the pair of third walls, each second groove joined to the corresponding first groove and extending orthogonally to the first groove, and the second wall has a pair of third grooves formed in its exterior wall face and extending in a direction orthogonal to an exterior wall face of the first wall.

2. The shock-absorbing packing material according to claim 1, characterized in that the paired third grooves extend in the exterior wall face of the second wall perpendicularly to a plane including the interior wall face of the first wall from a place at a distance of 25 millimeters from the interior wall face of the first wall on a side opposite to the exterior wall face thereof in a direction orthogonal to the exterior wall face of the first wall and trending toward an end of the second wall opposite to an end thereof adjoining the first wall.

3. The shock-absorbing packing material according to claim 1, characterized in that each of the pair of third grooves has a first interior face perpendicular to the exterior wall face of the second wall, and a second interior face in parallel to the first interior face, but closer to a center of the main body portion in a longitudinal direction thereof and shallower than the first interior face, and the first interior face is arranged so as to flush with the interior wall face of the third wall.

4. The shock-absorbing packing material according to claim 2, characterized in that each of the pair of third grooves has a first interior face perpendicular to the exterior wall face of the second wall, and a second interior face in parallel to the first interior face, but closer to a center of the main body portion in a longitudinal direction thereof and shallower than the first interior face, and the first interior face is arranged so as to flush with the interior wall face of the third wall.

5. A shock-absorbing packing material for lessening a physical shock to a television receiver with a cathode ray tube, which abuts against a corner ridge portion of the television receiver and lessens the shock when the television receiver is packed in a cardboard box, comprising:

an elongated main body portion having an L-like shape in section and including a first wall and a second wall orthogonal to the first wall; and a pair of third walls joined to the first wall and the second wall at two opposite ends of a lengthwise direction of the main body portion orthogonally to the first wall and the second wall, and integrated with the main body portion, the shock-absorbing packing material is composed of a foamed resin molding, the shock-absorbing packing material characterized in that the first wall has a pair of first grooves formed in a portion of an interior wall face of the first wall in connection with an interior wall face of the second wall, the pair of first grooves extending along the lengthwise direction, and a pair of second grooves formed in a portion of the interior wall face of the first wall in connection with an interior wall face of the corresponding one of the pair of third walls, each second groove joined to the corresponding first groove and extending orthogonally to the first groove, the second wall has a pair of third grooves formed in its exterior wall face, and extending perpendicularly to a plane including the interior wall face of the first wall from a place at a distance of 25 millimeters from the interior wall face of the first wall on a side opposite to the exterior wall face thereof in a direction orthogonal to the exterior wall face of the first wall and trending toward an end of the second wall opposite to an end thereof adjoining the first wall, each of the pair of third grooves has a first interior face perpendicular to the exterior wall face of the second wall, a second interior face in parallel to the first interior face, but closer to a center of the main body portion in a longitudinal direction thereof and shallower than the first interior face, and a third bottom face joining between the first interior face and the second interior face, and the first interior face is arranged so as to flush with the interior wall face of the third wall.

* * * * *